US008075457B2

(12) United States Patent
Campanaro et al.

(10) Patent No.: US 8,075,457 B2
(45) Date of Patent: Dec. 13, 2011

(54) INCLINABLE EXERCISE DEVICE WITH ABDOMINAL CRUNCH BOARD AND METHOD

(75) Inventors: Thomas J. Campanaro, Rancho Santa Fe, CA (US); Dan McCutcheon, San Diego, CA (US); Charles Josephn Mahon, Downington, PA (US)

(73) Assignee: Total Gym Global Corp., San Diego, CA (US)

( * ) Notice: Subject to any disclaimer, the term of this patent is extended or adjusted under 35 U.S.C. 154(b) by 0 days.

(21) Appl. No.: 12/857,667

(22) Filed: Aug. 17, 2010

(65) Prior Publication Data

US 2010/0311555 A1 Dec. 9, 2010

Related U.S. Application Data

(63) Continuation of application No. 12/111,310, filed on Apr. 29, 2008, now Pat. No. 7,775,950, which is a continuation-in-part of application No. 12/049,501, filed on Mar. 17, 2008, now abandoned, which is a continuation-in-part of application No. 11/688,539, filed on Mar. 20, 2007, now Pat. No. 7,503,880, which is a continuation-in-part of application No. 10/785,541, filed on Feb. 24, 2004, now Pat. No. 7,270,628.

(60) Provisional application No. 60/896,592, filed on Mar. 23, 2007, provisional application No. 60/790,325, filed on Apr. 6, 2006, provisional application No. 60/939,789, filed on May 23, 2007, provisional application No. 60/806,146, filed on Jun. 29, 2006.

(51) Int. Cl.
*A63B 21/00* (2006.01)

(52) U.S. Cl. ..... 482/96; 482/130; 482/142

(58) Field of Classification Search ..... 482/96, 482/130, 142
See application file for complete search history.

(56) References Cited

U.S. PATENT DOCUMENTS

| | | | |
|---|---|---|---|
| 3,658,327 | A | 4/1972 | Thiede |
| 4,004,801 | A | 1/1977 | Campanaro et al. |
| 4,101,124 | A | 7/1978 | Mahnke |
| 4,383,684 | A | 5/1983 | Schliep |
| D289,882 | S | 5/1987 | Gringer |
| 4,706,953 | A | 11/1987 | Graham |
| 4,911,438 | A | 3/1990 | Van Straaten |
| 5,169,363 | A | 12/1992 | Campanaro et al. |
| 5,224,914 | A | 7/1993 | Friedman |
| D364,902 | S | 12/1995 | Fleming |
| 5,545,114 | A | 8/1996 | Gvoich |
| D381,378 | S | 7/1997 | Colonello et al. |

(Continued)

FOREIGN PATENT DOCUMENTS

| | | |
|---|---|---|
| JP | D1091689 | 11/2000 |

(Continued)

*Primary Examiner* — Jerome w Donnelly
(74) *Attorney, Agent, or Firm* — Stephen C. Beuerle; Procopio, Cory, Hargreaves & Savitch LLP

(57) ABSTRACT

An abdominal crunch board for an inclinable exercise device includes a handle bar including opposite terminating engagement portions; a pair of opposing brackets coupled to the opposite terminating engagement portions, the pair of opposing brackets and the opposite terminating engagement portions forming a frame; a padded support coupled to the frame; and the opposing brackets are removably attachable to an adjustable incline of the inclinable exercise device at one or both of a location between a first end of the adjustable incline and a user support platform of the inclinable exercise device and a location between a second end of the adjustable incline and the user support platform.

16 Claims, 3 Drawing Sheets

U.S. PATENT DOCUMENTS

| | | | |
|---|---|---|---|
| D383,811 | S | 9/1997 | Ho |
| D385,930 | S | 11/1997 | Chen |
| 5,725,463 | A | 3/1998 | Colonello et al. |
| 5,752,901 | A | 5/1998 | Lee |
| D405,132 | S | 2/1999 | Westfall et al. |
| D408,477 | S | 4/1999 | Arnold et al. |
| 5,938,571 | A | 8/1999 | Stevens |
| 5,967,955 | A | 10/1999 | Westfall et al. |
| 6,117,055 | A | 9/2000 | Boland |
| 6,117,057 | A | 9/2000 | Olschansky et al. |
| 6,186,926 | B1 | 2/2001 | Ellis |
| 6,220,995 | B1 | 4/2001 | Chen |
| 6,390,960 | B1 | 5/2002 | Boland |
| D476,384 | S | 6/2003 | Perez |
| D476,921 | S | 7/2003 | Mehrmann et al. |
| D493,853 | S | 8/2004 | Campanaro et al. |
| D496,701 | S | 9/2004 | Chung |
| 6,921,355 | B2 | 7/2005 | Campanaro et al. |
| 6,966,871 | B2 | 11/2005 | Parmater |
| 7,220,221 | B2 | 5/2007 | Mosimann et al. |
| D544,050 | S | 6/2007 | Webber |
| 7,270,628 | B2 | 9/2007 | Campanaro et al. |
| D574,901 | S | 8/2008 | Campanaro et al. |
| D585,947 | S | 2/2009 | Royster |
| 7,503,880 | B2 | 3/2009 | Campanaro et al. |
| D608,401 | S | 1/2010 | Campanaro et al. |
| D612,000 | S | 3/2010 | Campanaro et al. |
| 7,722,512 | B2 | 5/2010 | Llang et al. |
| 2001/0056011 | A1 | 12/2001 | Endelman et al. |
| 2002/0082146 | A1 | 6/2002 | Stearns |
| 2005/0148437 | A1 | 7/2005 | Ryan et al. |
| 2005/0159277 | A1 | 7/2005 | McVay et al. |
| 2005/0159278 | A1 | 7/2005 | McVay et al. |
| 2007/0093369 | A1 | 4/2007 | Bocchicchio |
| 2007/0111866 | A1 | 5/2007 | McVay et al. |
| 2008/0161173 | A1 | 7/2008 | Campanaro et al. |
| 2008/0200317 | A1 | 8/2008 | Campanaro et al. |
| 2009/0018000 | A1 | 1/2009 | Brown et al. |
| 2009/0181834 | A1 | 7/2009 | Campanaro et al. |
| 2010/0062916 | A1 | 3/2010 | Campanaro et al. |

FOREIGN PATENT DOCUMENTS

| | | |
|---|---|---|
| JP | D1331682 | 6/2008 |
| TW | 589088 | 4/1992 |

INCLINABLE EXERCISE DEVICE WITH ABDOMINAL CRUNCH BOARD AND METHOD

CROSS-REFERENCE TO RELATED APPLICATIONS

This application is a continuation of Ser. No. 12/111,310, filed Apr. 29, 2008, now U.S. Pat. No. 7,775,950, which is a continuation-in-part of U.S. patent application Ser. No. 12/049,501, filed Mar. 17, 2008, which is continuation-in-part of U.S. patent application Ser. No. 11/688,539, filed Mar. 20, 2007, now U.S. Pat. No. 7,503,880, which is a continuation-in-part of U.S. patent application Ser. No. 10/785,541, filed Feb. 24, 2004, now U.S. Pat. No. 7,270,628, and claims the benefit of U.S. Provisional Patent Application 60/939,789, filed May 23, 2007 under 35 U.S.C. 119(e), U.S. Provisional Application 60/896,592, filed Mar. 23, 2007, U.S. Provisional Application 60/806,146, filed Jun. 29, 2006, and U.S. Provisional Application 60/790,325, filed Apr. 6, 2006. All of these applications/patent(s) are incorporated by reference as though set forth in full.

FIELD OF THE INVENTION

The present invention relates, in general, to accessories for an inclinable exercise device and, in particular, to accessories for an inclinable exercise device for exercising one's abdominal muscles and/or back muscles.

SUMMARY OF THE INVENTION

As aspect of the invention involves an abdominal crunch board for an inclinable exercise device. The inclinable exercise device includes a vertical support member; an adjustable incline having a first end and a second end, the first end of the adjustable incline adjustably supported by, and vertically movable with respect to, the vertical support member for adjusting the incline of the adjustable incline; a user support platform movably attached to the adjustable incline for movement of the support platform along the adjustable incline. The abdominal crunch board includes a handle bar including opposite terminating engagement portions; a pair of opposing brackets coupled to the opposite terminating engagement portions, the pair of opposing brackets and the opposite terminating engagement portions forming a frame; a padded support coupled to the frame; and the opposing brackets are removably attachable to the adjustable incline at one or both of a location between the first end of the adjustable incline and the user support platform and a location between the second end of the adjustable incline and the user support platform.

Another aspect of the invention involves a method of using an abdominal crunch board with an inclinable exercise device. The inclinable exercise device includes a vertical support member; an adjustable incline having a first end and a second end, the first end of the adjustable incline adjustably supported by, and vertically movable with respect to, the vertical support member for adjusting the incline of the adjustable incline; a user support platform movably attached to the adjustable incline for movement of the support platform along the adjustable incline. The method includes removably attaching an abdominal crunch board to the adjustable incline at a location including one or both of a location between the first end of the adjustable incline and the user support platform and a location between the second end of the adjustable incline and the user support platform; kneeling on the user support platform; supporting one's forearms on the abdominal crunch board; and moving the user support platform and one's knees together towards the abdominal crunchboard and away from the abdominal crunchboard.

DETAILED DESCRIPTION OF PREFERRED EMBODIMENTS

Figure 1:
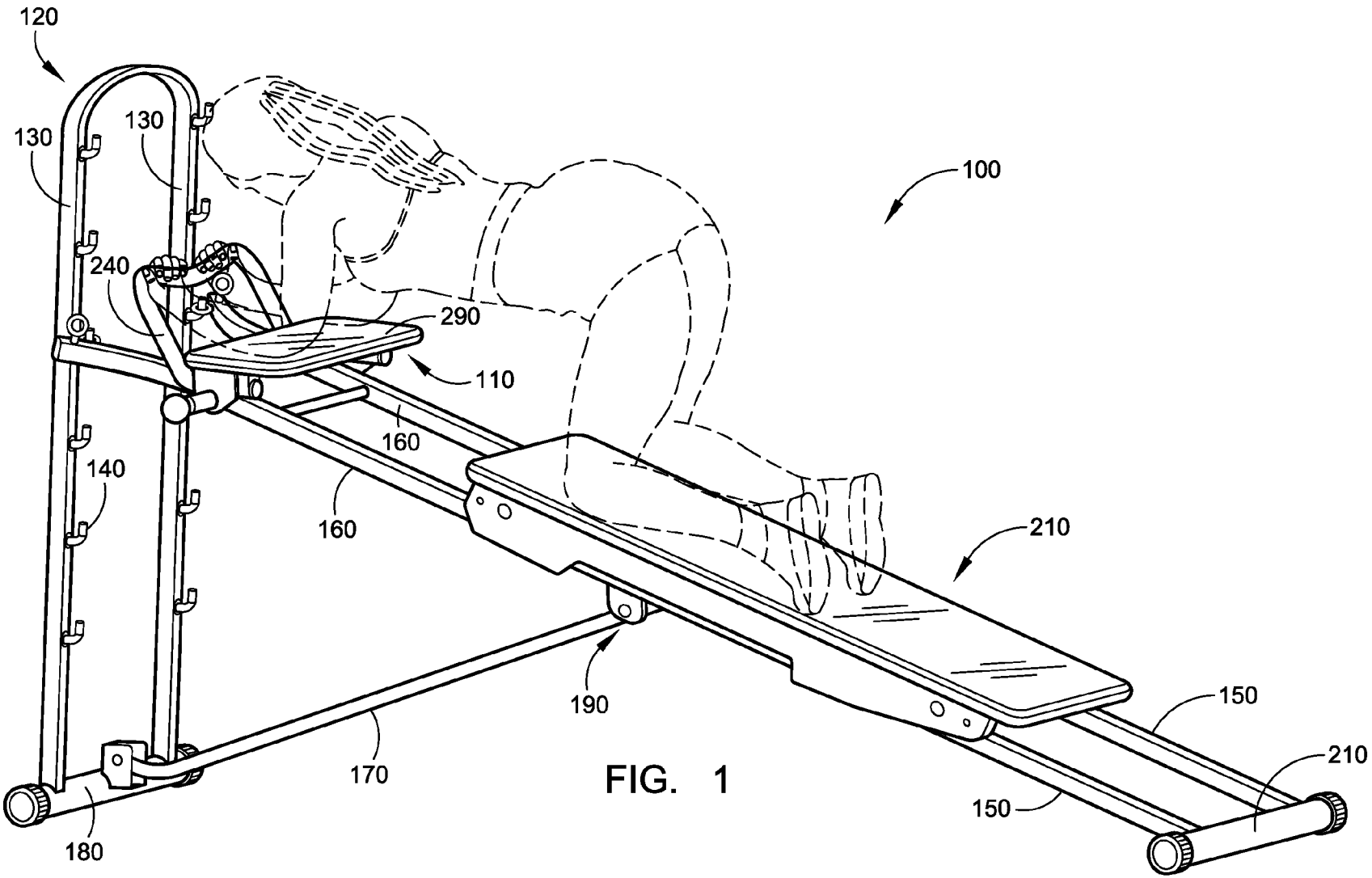
FIG. 1 is a perspective view of an embodiment of an inclinable exercise device including an embodiment of an abdominal crunch board mounted to top rails of the inclinable exercise device, and shows a user on the inclinable exercise device using the abdominal crunch board.

With reference to FIGS. 1-8, an embodiment of an inclinable exercise device 100 including an embodiment of an abdominal ("ab") crunch board 110 and method of using the same will be described.

Before describing the ab crunch board 110, the inclinable exercise device 100 will first be generally described. The inclinable exercise device 100 includes a vertical support member in the form of a ladder/tower 120 with a pair of vertical support members 130. Although two vertical support members 130 are shown, in an alternative embodiment, the tower 120 includes one or more vertical support members 130. Extending from the front of vertical support members 130 are catches 140.

Lower rails 150 are pivotally coupled to upper rails 160 to form an adjustable incline having a first end and a second end. A strut 170 is pivotably coupled to a base tube 180 at the lower end of the vertical support members 130 and is also pivotably connected to a rail pivot point 190. Lower ends of lower rails 150 terminate at a base tube 200.

A user support platform or glideboard 210 with rollers (not shown) rolls along the rails 150, 160.

Pulley supports 220 are connected to upper ends of upper rails 160. Attached to the pulley supports 220 are pulleys (not shown). Although not shown, a connector extends through the pulleys and connects to an upper end of the glideboard 210. The connector may be of any suitable well-known type, but is preferably a cable with handles at each end. The cable extends through the pulleys connected to the upper ends of the upper rails 160 and loops through a third pulley (not shown) attached to an upper end of the glideboard 210. The third pulley is positioned along the lateral centerline of the glideboard 210. This position allows for unilateral (i.e. one arm), bilateral (i.e., two arm) and static equilibrium (i.e. holding the glideboard 210 suspended by keeping a constant force on each handle) use. The cable should preferably be of sufficient length to extend through the pulleys and allow the exerciser to grasp one or both of the handles while the exerciser is on the glideboard 210 and the glideboard 210 is at rest.

In an alternate embodiment, the connector is two separate cables extending through the pulleys connected to the upper ends of the upper rails 160 with each cable fixedly attached to an upper end of the glideboard 210.

A user adjusts the incline of the rails 150, 160 to adjust the resistance level of the inclinable exercise device 100. To adjust the incline of the rails 150, 160, a user lifts the upper ends of the upper rails 160 so that rail hooks 230 at the upper ends of the upper rails 160 are disengaged from (i.e., lifted off of) the catches 140. The rails 150, 160 are then positioned at the desired level/incline relative to the vertical support members 130 and the rail hooks 230 at the upper ends of the upper rails 160 are placed onto the catches 140 to secure the upper ends of the upper rails 160 to the vertical support members 130.

The ab crunch board 110 will now be described in more detail. The ab crunch board 110 includes a handle bar 240 with two mirror-image brackets 250 welded to each side to create a frame 260. The handle bar 240 is substantially U-shaped with a central incurved hand grip portion 270. The handle bar 240 terminates in opposite terminating engagement portions 275. A pull pin barrel 280 is welded to each bracket 250 and is painted black with texture for grip. An upholstered padded board or support 290 is bolted to the frame 260. Pull pins 300 are screwed into the barrels 280.

The ab crunch board 110 is installed on either the upper rails 160 (FIG. 1), with the central incurved hand grip portion 270 facing upwards towards the tower 120 and adjacent the upper ends of the upper rails 160, or on the lower rails 150 (FIG. 2), with the central incurved hand grip portion 270 facing downwards towards the base tube 200 and adjacent the lower ends of the lower rails 150 for different exercises. To install the ab crunch board 110 onto the rails 150, 160, one side of the ab crunch board 110 is lowered onto the rail 150, 160 and causing the pull pin 280 to engage a mounting hole of the rail 150, 160. The opposite pull pin 280 is pulled outwardly and that side of the ab crunch board 110 is lowered on the corresponding rail 150, 160. This pull pin 280 is released so that it engages the mounting hole in the rail 150, 160. The ab crunch board 110 is secured to the rails 150, 160 with a lower surface of the opposite terminating engagement portions 275 resting on top of the rails 150, 160. In embodiments of the rails 150, 160 where the rails do not have mounting holes, the ab crunch board 110 includes socket mounts to mount the ab crunch board 110 to the rails 150, 160.

Figure 3:
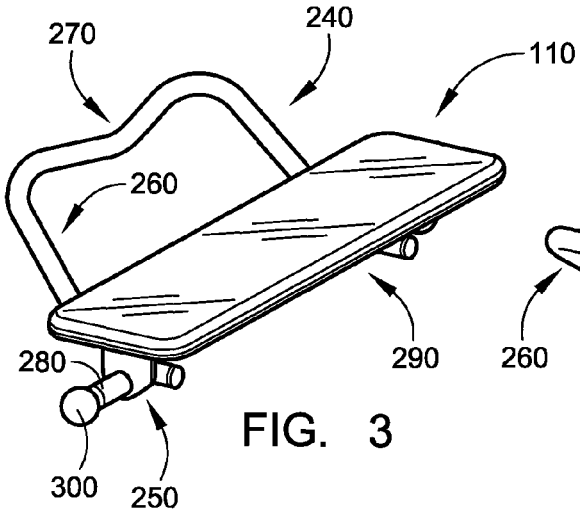
FIG. 3 is a top perspective view of the abdominal crunch board illustrated in FIGS. 1 and 2.
Figure 4:
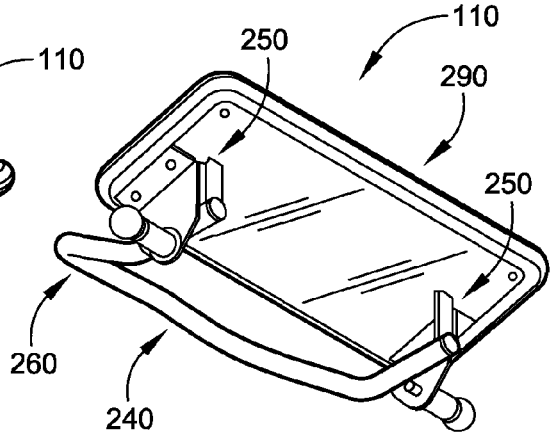
FIG. 4 is a bottom perspective view of the abdominal crunch board illustrated in FIGS. 1 and 2.
Figure 5:
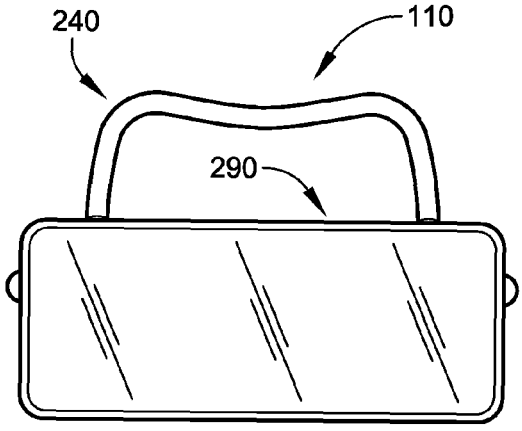
FIG. 5 is a top plan view of the abdominal crunch board illustrated in FIGS. 1 and 2.
Figure 6:
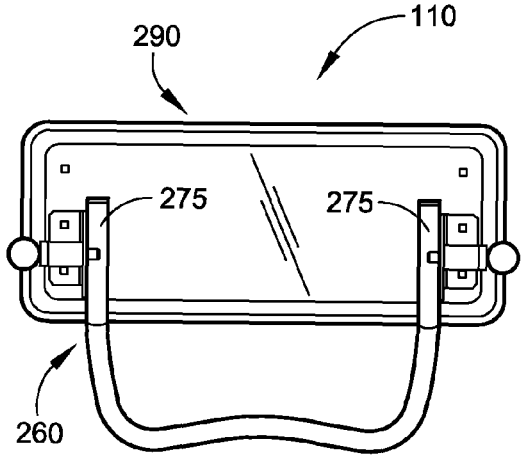
FIG. 6 is a bottom plan view of the abdominal crunch board illustrated in FIGS. 1 and 2.
Figure 7:
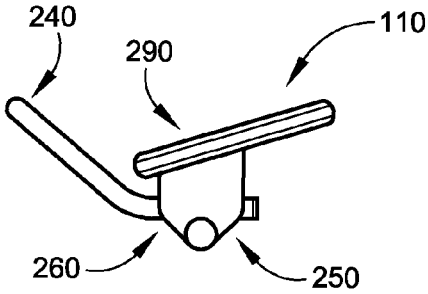
FIG. 7 is a left side-elevational view of the abdominal crunch board illustrated in FIGS. 1 and 2, the right side-elevational view being a mirror image of FIG. 7.
Figure 8:
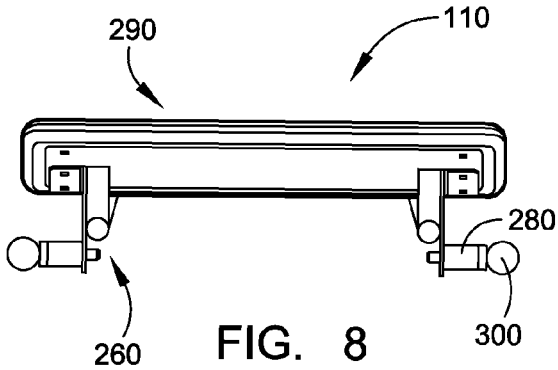
FIG. 8 is a front elevational view of the abdominal crunch board illustrated in FIGS. 1 and 2.

With reference to FIGS. 1 and 3, a method of exercising using the ab crunch board 110 installed near the upper ends of upper rails 160 will be described. With the cable(s) and handles removed from the inclinable exercise device 100, a user exercises one's abdominal and oblique muscles in calibrated loaded contractions depending on the level of incline of the rails 160, 160 with respect to the tower 120. A straight-on ab pull is performed by the user holding the handle bar 240 with one's hands and resting one's forearms on the padded board 290. The user then lies flat (downward facing) on the movable glideboard 210 and grips the handle bar 240 at the central incurved hand grip portion 270 or at another location of the handle bar 240. The user then crawls or walks one's lower body forward on the movable glideboard 210 so that the user is kneeling on the glideboard 210 with one's knees near the end of the glideboard 210 closest to the ab crunch board 110 as shown in FIG. 1. Using primarily one's abdominal muscles the user tries to pull one's knees into one's chest. This causes the glideboard to move forward so one's knees (with the glideboard 210) move under one's torso. In an exemplary method, this is performed with one's feet off the glideboard 210. This method of exercising one's abdominal muscles allows users to work almost their complete range of body motion at more or less resistance (i.e., by adjusting the incline of the rails 150, 160).

In another method of exercising using the ab crunch board 110, a user exercises one's obliques in a similar manner by kneeling on the glideboard 210, but with one's torso twisted to the side. The user grips the handle bar 240 at the central incurved hand grip portion 270 or at another location of the handle bar 240 (e.g., straight lateral sections of handle bar 24) with one's forearms rested on padded board 290 and pulls one's knees up towards one's chest again. Using primarily one's oblique muscles the user tries to pull one's knees into one's chest. This causes the glideboard 210 to move forward so one's knees (with the glideboard 210) move under one's torso. In an exemplary method, this is performed with one's feet off or partially off the side of the glideboard 210.

Figure 2:
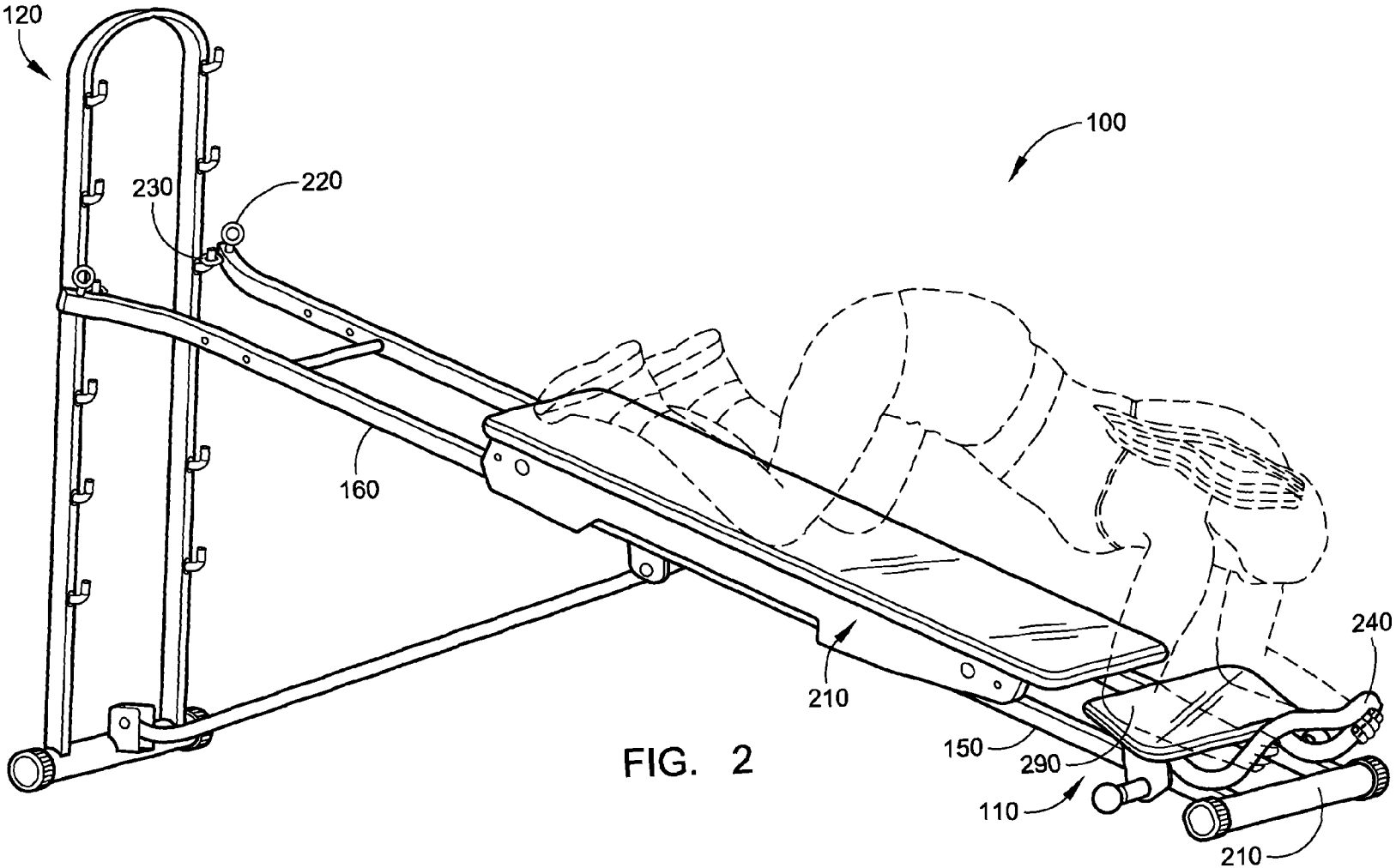
FIG. 2 is a perspective view of an embodiment of an inclinable exercise device including an embodiment of an abdominal crunch board mounted to bottom rails of the inclinable exercise device, and shows a user on the inclinable exercise device using the abdominal crunch board.

With reference to FIGS. 2 and 3, in a further method of exercising using the ab crunch board 110 a user works one's lower back and upper abdominal muscles in extension by exercising using the ab crunch board 110 installed near the lower end of the lower rails 150. To do this exercise, the user lies down on the glideboard 210 facing down and grasps the handle bar 240 at the central incurved hand grip portion 270 or at another location of the handle bar 240 (e.g., straight lateral sections of handle bar 24) with one's forearms rested on padded board 290. The glideboard 210 is then pushed up, away from the ab crunch board 110, and one crawls or walks one's knees or feet down the glideboard 210 until the glideboard 210 is as far away from one's arms as possible and one's body is substantially level with the rails 150, 160 as shown in FIG. 2. The user may lift one's feet off the glideboard 210 so that the user's knees support one's weight on the glideboard 210. Then the user pulls one's hips upwards, away from the rails 150, 160, as one allows the glideboard 210 to roll down the rails 150, 160 towards the ab crunch board 110. An advance version includes keeping one's legs straight so that one's feet support the user's weight on the glideboard 210 and the user lifts one's forearms off the padded board 290 so that the user only holds onto (and contacts) the handle bar 270.

The ab crunch board 110 in conjunction with the inclinable exercise device 100 allows a user to perform a wide variety of downward-facing crunch exercises to exercise one's abdominal muscles, oblique muscles, and lower back muscles with almost a complete range of body motion and at multiple different resistance levels.

The above figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

What is claimed is:

1. A method of using an abdominal crunch board with an inclinable exercise device, comprising:

providing an inclinable exercise device including a vertical support member; an adjustable incline having a first end and a second end, the first end of the adjustable incline adjustably supported by, and vertically movable with respect to, the vertical support member for adjusting the incline of the adjustable incline; a user support platform movably attached to the adjustable incline for movement of the support platform along the adjustable incline;

removably attaching an abdominal crunch board to the adjustable incline at a location including one or both of a location between the first end of the adjustable incline and the user support platform and a location between the second end of the adjustable incline and the user support platform;

kneeling on the user support platform;

supporting one's forearms on the abdominal crunch board;

moving the user support platform and one's knees together towards the abdominal crunchboard and away from the abdominal crunchboard.

2. The method of claim 1, wherein removably attaching includes removably attaching an abdominal crunch board including a handle bar including opposite terminating engagement portions; a pair of opposing brackets coupled to the opposite terminating engagement portions, the pair of opposing brackets and the opposite terminating engagement portions forming a frame; a padded support coupled to the frame; and the opposing brackets are removably attachable to the adjustable incline at one or both of a location between the first end of the adjustable incline and the user support platform and a location between the second end of the adjustable incline and the user support platform.

3. The method of claim 2, wherein the handle bar is substantially U-shaped.

4. The method of claim 2, wherein the handle bar has a central incurved hand grip portion.

5. The method of claim 2, wherein the handle bar terminates in opposite terminating engagement portions connected respectively to the opposing brackets.

6. The method of claim 2, further including a pull pin barrel connected to each bracket.

7. The method of claim 2, wherein supporting one's forearms includes supporting one's forearms on the padded support and gripping the handlebar with one's hands.

8. The method of claim 2, wherein the handle bar includes inwardly angled straight lateral sections terminating in the opposite terminating engagement portions, the padded support defines a plane, and the opposite terminating engagement portions of the handle bar are disposed below the plane defined by the padded support and substantially all of the inwardly angled straight lateral sections are disposed above the plane defined by the padded support.

9. The method of claim 8, wherein the padded support includes a proximal end facing towards the user support platform and a distal end facing away from the user support platform, and substantially all of the inwardly angled straight lateral sections extend distally away from the distal end of the padded support above the plane defined by the padded support.

10. The method of claim 8, wherein the handle bar has a central incurved hand grip portion joining the inwardly angled straight lateral sections and the central incurved hand grip portion is disposed above the plane defined by the padded support.

11. The method of claim 2, wherein the padded support includes an upward-facing support surface that a user supports one's forearms on, the user support platform includes an upward-facing support surface that a user supports one's knees on, and the upward-facing support surface of the user support platform and the upward-facing support surface of the padded support facing upward in substantially the same direction.

12. The method of claim 1, wherein removably attaching includes removably attaching an abdominal crunch board including a handle bar including opposite terminating engagement portions; a pair of opposing brackets coupled to the opposite terminating engagement portions, the pair of opposing brackets and the opposite terminating engagement portions forming a frame; a padded support coupled to the frame, wherein the opposing brackets are removably attachable to the top and the bottom of the adjustable incline so that the abdominal crunch board is a two-position abdominal crunch board removably attachable to the top and the bottom of the adjustable incline.

13. The method of claim 12, wherein the handle bar includes inwardly angled straight lateral sections terminating in the opposite terminating engagement portions, the padded support defines a plane, and the opposite terminating engagement portions of the handle bar are disposed below the plane defined by the padded support and substantially all of the inwardly angled straight lateral sections are disposed above the plane defined by the padded support.

14. The method of claim 13, wherein the padded support includes a proximal end facing towards the user support platform and a distal end facing away from the user support platform, and substantially all of the inwardly angled straight lateral sections extend distally away from the distal end of the padded support above the plane defined by the padded support.

15. The method of claim 13, wherein the handle bar has a central incurved hand grip portion joining the inwardly angled straight lateral sections and the central incurved hand grip portion is disposed above the plane defined by the padded support.

16. The method of claim 12, wherein the padded support includes an upward-facing support surface that a user supports one's forearms on, the user support platform includes an upward-facing support surface that a user supports one's knees on, and the upward-facing support surface of the user support platform and the upward-facing support surface of the padded support facing upward in substantially the same direction.

* * * * *